US010192480B2

(12) United States Patent
Wang et al.

(10) Patent No.: US 10,192,480 B2
(45) Date of Patent: Jan. 29, 2019

(54) METHOD FOR CONTROLLING BRIGHTNESS OF AN ORGANIC LIGHT-EMITTING DIODE PANEL WHEN BOOTING

(71) Applicant: Shenzhen China Star Optoelectronics Technology Co., Ltd., Shenzhen, Guangdong (CN)

(72) Inventors: Zhenling Wang, Guangdong (CN); Tai-jiun Hwang, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 49 days.

(21) Appl. No.: 15/536,944

(22) PCT Filed: May 27, 2017

(86) PCT No.: PCT/CN2017/086231
§ 371 (c)(1),
(2) Date: Jun. 16, 2017

(87) PCT Pub. No.: WO2018/201541
PCT Pub. Date: Nov. 8, 2018

(65) Prior Publication Data

US 2018/0357949 A1 Dec. 13, 2018

(30) Foreign Application Priority Data

May 2, 2017 (CN) ..... 2017 1 0301471

(51) Int. Cl.
*G09G 3/3208* (2016.01)

(52) U.S. Cl.
CPC ... *G09G 3/3208* (2013.01); *G09G 2320/0276* (2013.01); *G09G 2320/0626* (2013.01); *G09G 2330/026* (2013.01); *G09G 2370/14* (2013.01)

(58) Field of Classification Search
CPC ..... G09G 5/10; G09G 2320/043; G09G 2330/021
See application file for complete search history.

(56) References Cited

U.S. PATENT DOCUMENTS

2005/0068345 A1 3/2005 Obata

FOREIGN PATENT DOCUMENTS

CN 102377956 A 3/2012
CN 105632414 A 6/2016
(Continued)

*Primary Examiner* — Shaheda Abdin
(74) *Attorney, Agent, or Firm* — Andrew C. Cheng

(57) ABSTRACT

A method for controlling brightness of an OLED panel when booting. The method includes steps of: obtaining a brightness to be displayed corresponding to each pixel in a booting process; comparing the brightness to be displayed of each pixel with a preset brightness threshold; if the brightness to be displayed is greater than the brightness threshold, adjusting the brightness to be displayed to be less than or equal to the brightness threshold; using the brightness to be displayed after adjusting to adjust a grayscale value to be displayed of the pixel; using the grayscale value to be displayed to control a corresponding pixel to perform a display; gradually increasing the brightness threshold with time, and returning to the step of obtaining a brightness to be displayed corresponding to each pixel in a booting process. The present invention can reduce the probability of the image sticking and the speed of ageing.

20 Claims, 5 Drawing Sheets

(56) References Cited

FOREIGN PATENT DOCUMENTS

| | | | |
|---|---|---|---|
| CN | 106033666 | A | 10/2016 |
| CN | 106227425 | A | 12/2016 |

METHOD FOR CONTROLLING BRIGHTNESS OF AN ORGANIC LIGHT-EMITTING DIODE PANEL WHEN BOOTING

BACKGROUND OF THE INVENTION

1. Field of the Invention

The present invention relates to a display technology field, and more particularly to a method for controlling brightness of an organic light-emitting diode panel when booting.

2. Description of Related Art

In a flat display technology, active-matrix organic light-emitting diode (AMOLED) has many advantages such as thin, active light-emitting, fast response, wide viewing angle, colorful, high brightness, low power consumption, resistant to high and low temperature so that the AMOLED is recognized as a third generation display technology after LCD, and has been widely applied in portable products such as mobile phones, digital cameras. An AMOLED TV screen with middle size is about to begin producing. However, because OLED is a current device, when the current is greater, the heat dissipation of the OLED device is greater. In the current driving device and driving method, if brightness of a picture when booting is too high, temperature of a portion region of the panel will be too high so that the OLED device is ageing too fat or burned. Too high brightness at a portion region will cause too large current at the portion region such that a voltage offset of TFT (Thin Film Transistor) is too large in order to generate a sticking image.

SUMMARY OF THE INVENTION

The main technology problem solved by the present invention is providing a method for controlling brightness of an organic light-emitting diode panel when booting, which can reduce the probability of the image sticking of the panel caused by too large voltage offset when booting, decreasing too fast ageing of the panel device because of too large local current.

In order to solve the above technology problem, a technology solution adopted by the present invention is: providing a method for controlling brightness of an organic light-emitting diode panel when booting, the organic light-emitting diode panel includes multiple pixels, and the method comprises step of: obtaining a brightness to be displayed corresponding to each pixel in a booting process; comparing the brightness to be displayed of each pixel with a preset brightness threshold; if the brightness to be displayed is greater than the brightness threshold, adjusting the brightness to be displayed to be less than or equal to the brightness threshold; using the brightness to be displayed after adjusting to adjust a grayscale value to be displayed of the pixel; using the grayscale value to be displayed to control a corresponding pixel to perform a display; gradually increasing the brightness threshold with time, and returning to the step of obtaining a brightness to be displayed corresponding to each pixel in a booting process.

In order to solve the above technology problem, a technology solution adopted by the present invention is: providing a method for controlling brightness of an organic light-emitting diode panel when booting, the organic light-emitting diode panel includes multiple pixels, and the method comprises step of: obtaining a brightness to be displayed corresponding to each pixel in a booting process; comparing the brightness to be displayed of each pixel with a preset brightness threshold; if the brightness to be displayed is greater than the brightness threshold, adjusting the brightness to be displayed to be less than or equal to the brightness threshold; using the brightness to be displayed after adjusting to control a corresponding pixel to perform a display.

In order to solve the above technology problem, a technology solution adopted by the present invention is: providing an organic light-emitting diode panel, and the panel comprises: a processor, a storage device, a receiver and a display device, wherein, the processor is connected with the receiver and the display device; the receiver is used for obtaining a brightness to be displayed corresponding to each pixel in a booting process; the processor is used for comparing the brightness to be displayed of each pixel with a preset brightness threshold; if a brightness to be displayed is greater than the brightness threshold, adjusting the brightness to be displayed to be less than or equal to the brightness threshold; and the display is used for using the brightness to be displayed after adjusting to control a corresponding pixel to perform a display.

The advantageous effect of the present invention is: comparing with the conventional art, in the present invention, obtaining a brightness to be displayed corresponding to each pixel in a booting process first. Then, comparing the brightness to be displayed of each pixel with a preset brightness threshold. If a brightness to be displayed is greater than the brightness threshold, adjusting the brightness to be displayed to be less than or equal to the brightness threshold. Then, using the brightness to be displayed after adjusting to control a corresponding pixel to perform a display. Accordingly, the brightness of the picture is decreased in the booting process in order to reduce the probability of the image sticking of the panel caused by too large voltage offset when booting, decreasing too fast ageing of the panel device because of too large local current.

DETAILED DESCRIPTION OF THE PREFERRED EMBODIMENT

Figure 1:
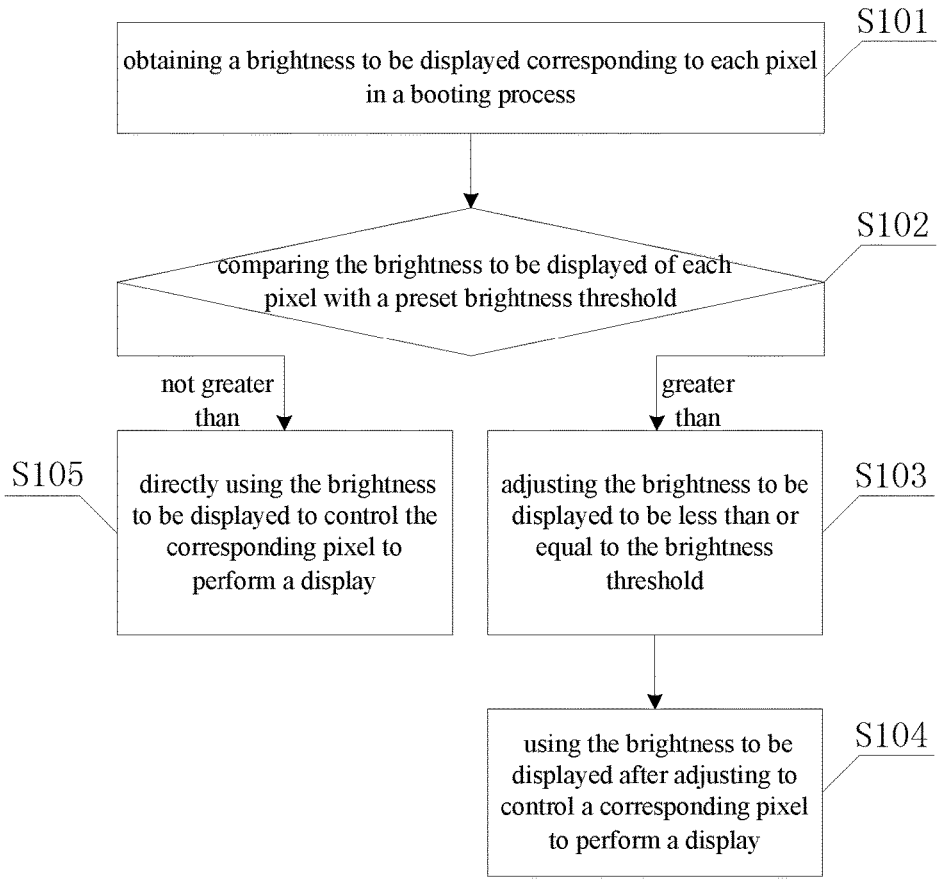
FIG. 1 is a flow chart of a method for controlling brightness of an organic light-emitting diode panel when booting according to an embodiment of the present invention.

With reference to FIG. 1, and FIG. 1 is a flow chart of a method for controlling brightness of an organic light-emitting diode panel when booting according to an embodiment of the present invention. It should be noted that if the result is substantially the same, the method of the present invention is not limited to the sequence shown in FIG. 1. Wherein, the organic light-emitting panel of the present invention includes multiple pixels. As shown in FIG. 1, the method includes following steps:

S101: obtaining a brightness to be displayed corresponding to each pixel in a booting process.

In a normal situation, during a booting period of an OLED panel, the pixels will not emit light simultaneously. Generally, a portion of the pixels will emit light first, and the other portion of the pixels will emit light soon after. If a brightness to be displayed of the portion of the pixel that emit light first is too high, a brightness of a portion region of the OLED panel is too high, which means that a current of the portion region of the OLED panel is too high so that an offset of a voltage for driving the TFT is too large in order to cause an ageing of the device of the OLED panel to be faster or to be burned, and generating an image sticking phenomenon on the OLED panel. The image sticking phenomenon means a residual image on the display. That is, when switching images on the display, a previous image will not disappear immediately, the visual effect of the previous image will appear simultaneously with a second image, and the previous image will disappear slowly.

Therefore, in the present embodiment, controlling a brightness to be displayed of a portion of the pixels that will emit light first, that is, controlling currents of the portion of the pixels.

S102: comparing the brightness to be displayed of each pixel with a preset brightness threshold.

Wherein, the preset brightness threshold is a critical brightness value of an OLED panel that will not generate a sticking image. During a booting period, the brightness to be displayed of each pixel is compared with the preset brightness threshold.

S103: If the brightness to be displayed is greater than the brightness threshold, adjusting the brightness to be displayed to be less than or equal to the brightness threshold.

Wherein, one of specific embodiments for the step of adjusting the brightness to be displayed to be less than or equal to the brightness threshold is shown as following:

Through a following formula to adjust a brightness to be displayed:

$$Y'_{out}=Y'\times K;$$

wherein, $K=Y_{th}/Y'_{max}$, Y' is a brightness to be displayed before adjustment, $Y'_{out}$ is a brightness to be displayed after adjustment, $Y_{th}$ is the brightness threshold, $Y'_{max}$ is a greatest brightness of the brightness to be displayed of the multiple pixels.

S104: using the brightness to be displayed after adjusting to control a corresponding pixel to perform a display.

S105: if the brightness to be displayed is less than or equal to the brightness threshold, directly using the brightness to be displayed to control the corresponding pixel to perform a display.

Specifically, when the brightness to be displayed of the portion of the pixels which emits light first is less than or equal to the brightness threshold, directly using the brightness to be displayed to control the corresponding pixel to perform a display. If the brightness to be displayed is greater than the brightness threshold, adjusting the brightness to be displayed to be less than or equal to the brightness threshold.

In summary, in the booting period, the brightness to be displayed of each pixel should be less than or equal to the brightness threshold.

In the present embodiment, obtaining a brightness to be displayed corresponding to each pixel in a booting process first. Then, comparing the brightness to be displayed of each pixel with a preset brightness threshold. If a brightness to be displayed is greater than the brightness threshold, adjusting the brightness to be displayed to be less than or equal to the brightness threshold. Then, using the brightness to be displayed after adjusting to control a corresponding pixel to perform a display. Accordingly, the brightness of the picture is decreased in the booting process in order to reduce the probability of the image sticking of the panel caused by too large voltage offset when booting, decreasing too fast ageing of the panel device because of too large local current.

Figure 2:
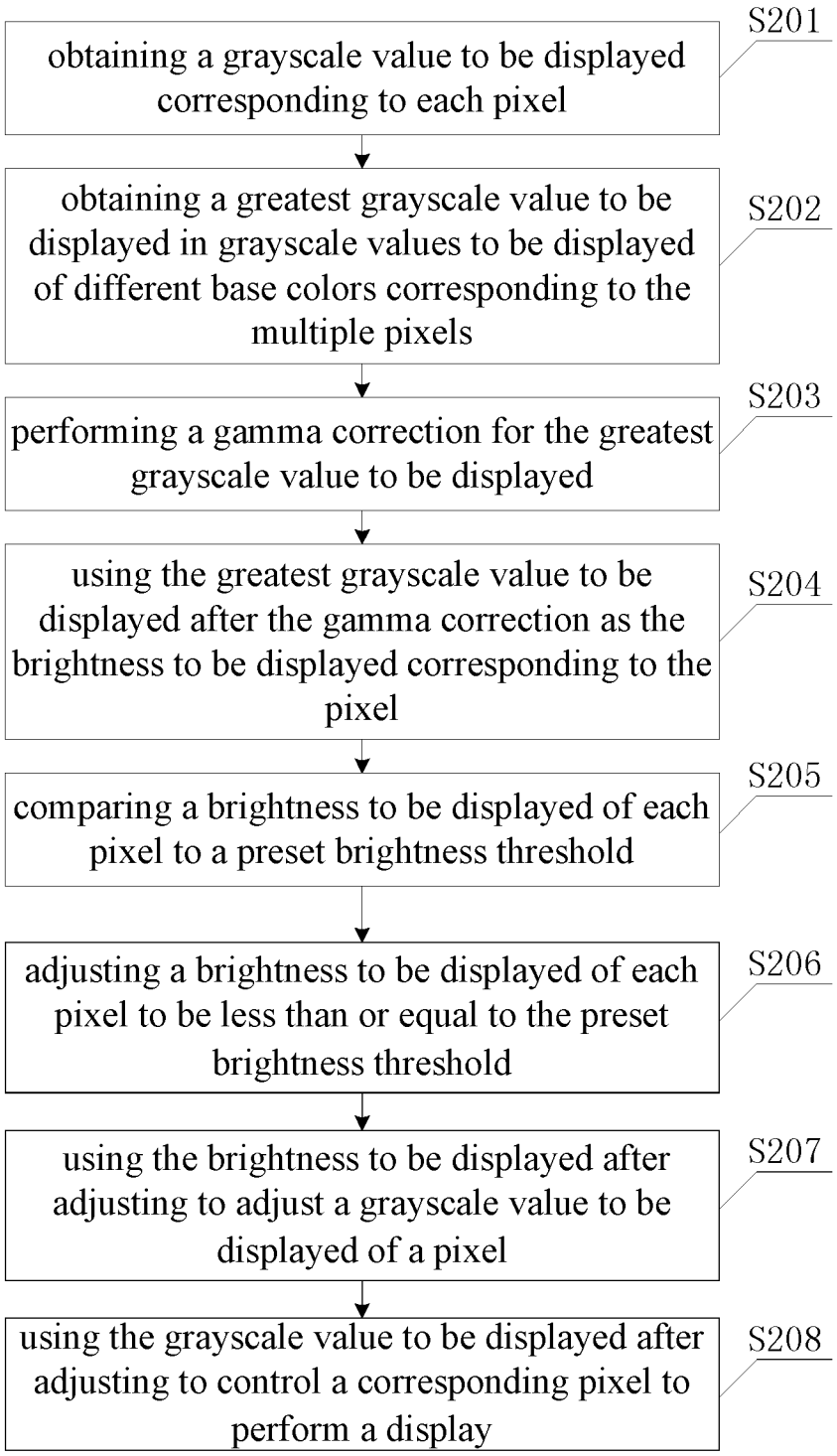
FIG. 2 is a flow chart of a method for controlling brightness of an OLED panel in a booting process according to another embodiment of the present invention.

With reference to FIG. 2, FIG. 2 is a flow chart of a method for controlling brightness of an OLED panel in a booting process according to another embodiment of the present invention, in the present embodiment, the method includes following steps:

S201: obtaining a grayscale value to be displayed corresponding to each pixel.

Wherein, because data outputted from a front end is the grayscale values of the pixels, the step of obtaining a grayscale value to be displayed corresponding to each pixel is required first. Then, calculating the grayscale value to be displayed corresponding to each pixel as the brightness to be displayed corresponding to each pixel. The specific calculation process is as following:

S202: obtaining a greatest grayscale value to be displayed in grayscale values to be displayed of different base colors corresponding to the multiple pixels.

Wherein, the different base colors corresponding to the multiple pixels are specifically Red/Green/Blue (R/GB). That is, obtaining a base color that has the greatest grayscale value to be displayed in R/G/B.

S203: performing a gamma correction for the greatest grayscale value to be displayed.

Wherein, the gamma correction is editing the gamma curve of an image, and performing a non-linear hue editing to detect a dark color portion and a light color portion in the image signal, and increasing a ratio of the both in order to increase a contrast of the image. That is, the main purpose of the gamma correction is to increase a contrast of the grayscale value to be displayed. The step of performing a gamma correction for the grayscale value to be displayed is specific as following:

Through a following formula to perform the gamma correction for the greatest grayscale value to be displayed:

$$Y'=(Y/N)^{GMA}\times N;$$

wherein, Y is the greatest grayscale value to be displayed before the gamma correction, Y' is the greatest grayscale value to be displayed after the gamma correction, GMA is a gamma coefficient of the OLED panel, N is a greatest allowable grayscale value of the OLED panel.

S204: using the greatest grayscale value to be displayed after the gamma correction as the brightness to be displayed corresponding to the pixel.

S205: comparing a brightness to be displayed of each pixel to a preset brightness threshold.

As the description at the above S102, no more repeating here.

S206: adjusting a brightness to be displayed of each pixel to be less than or equal to the preset brightness threshold.

Wherein, if the brightness to be displayed is greater than the brightness threshold, adjusting the brightness to be displayed to be less than or equal to the brightness threshold, if a brightness to be displayed is less than or equal to the brightness threshold, directly using the brightness to be displayed to control a corresponding pixel to perform a display.

S207: using the brightness to be displayed after adjusting to adjust a grayscale value to be displayed of a pixel.

S208: using the grayscale value to be displayed after adjusting to control a corresponding pixel to perform a display.

Figure 3:
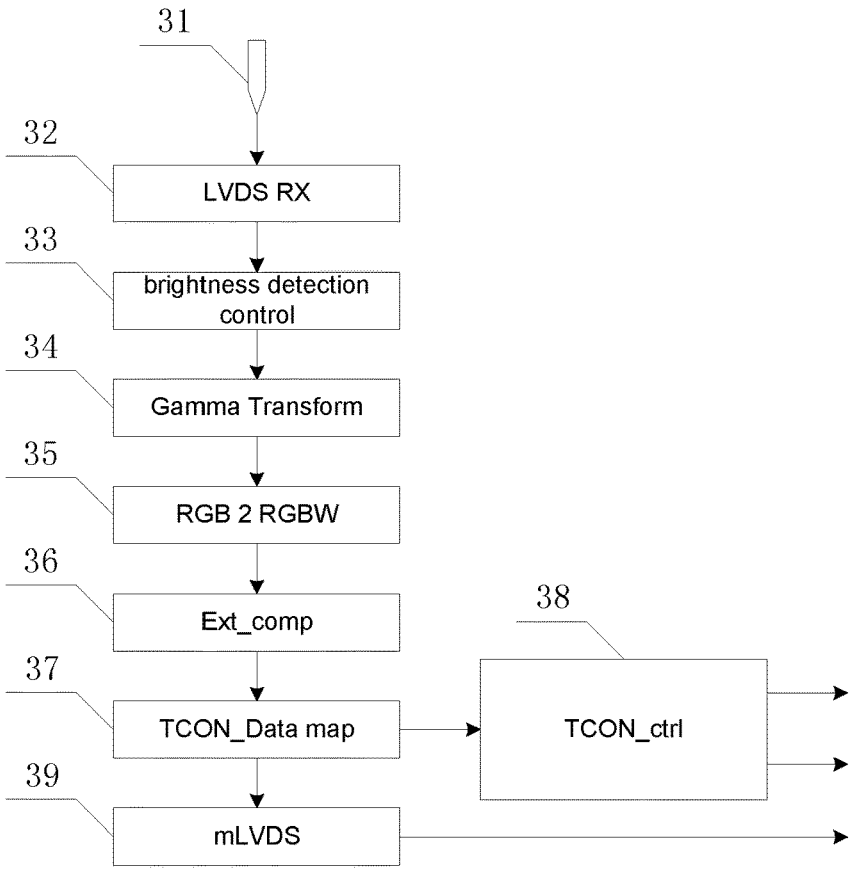
FIG. 3 is a schematic diagram of a module for brightness control of an OLED panel under a booting process according to the present invention.

In a specific application field, as shown in FIG. 3, FIG. 3 is a schematic diagram of a module for brightness control of an OLED panel under a booting process according to the present invention. Wherein, a module 31 represents a video signal; a module 32, LVDS RX, represents demodulating data with LVDS format to data with RGB format; a module 33, brightness detection control, represents when detecting that a brightness to be displayed of a pixel inputting to the panel is greater than the preset brightness threshold, decreasing the brightness of the image, and when detecting that a brightness to be displayed of a pixel inputting to the panel is less than the preset brightness threshold, maintaining the brightness of the image; a module 34, Gamma Transform, represents an adjustment of a gamma white balance; a module 35, RGB 2 RGBW, represents transforming data having RGB format to data having RGBW format through an algorithm; a module 36, Ext_comp, represents collecting parameters of TFT and OLED of the panel, and performing a compensation for an image uniformity through an algorithm; a module 37, TCON_Data map, represents combining a timing of the gate driver and the source driver to output RGB data to mLVDS; a module 38, TCON_ctrl, represents combining a timing of gate driver and source driver, providing control signals that parameters of the control signals meet requirements; a module 39, mLVDS, represents transforming data having RGB format into data having mLVDS format.

Wherein, the video signal inputted from the module 31 is grayscale values to be displayed of pixels. Therefore, in the above embodiment, requiring processing the grayscale values to be displayed of the pixels, after being transformed as a brightness to be displayed, comparing with the preset brightness threshold.

Wherein, LVDS (Low-Voltage Differential Signaling) is a signal transmitting mode, and is a voltage level standard. The core of the technology is adopting an ultra-low voltage amplitude to differentially transmit signal in a high speed in order to achieve a connection of one point to one point or one point to multiple point, which has features of low power consumption, low error code rate, low crosstalk and low radiation. The transmission medium can be a PCB connection line made of copper or a balance cable. The LVDS technology is used for simple physical layer device of simple line driver or receiver, and communication chip having more complicated ports. Wherein, the difference between LVDS and mLVDS is that an arrangement way of the output data is different.

Wherein, the module 33, the brightness detection control, is also the above embodiment.

Besides, the output signal of the module 38, TCON_ctrl, is transmitted to the scanning line of the panel, the output signal of the module 39, mLVDS, is transmitted to the data line of the panel.

In the present embodiment, obtaining a brightness to be displayed corresponding to each pixel in a booting process first. Then, comparing the brightness to be displayed of each pixel with a preset brightness threshold. If a brightness to be displayed is greater than the brightness threshold, adjusting the brightness to be displayed to be less than or equal to the brightness threshold. Then, using the brightness to be displayed after adjusting to control a corresponding pixel to perform a display. Accordingly, the brightness of the picture is decreased in the booting process in order to reduce the probability of the image sticking of the panel caused by too large voltage offset when booting, decreasing too fast ageing of the panel device because of too large local current.

Figure 4:
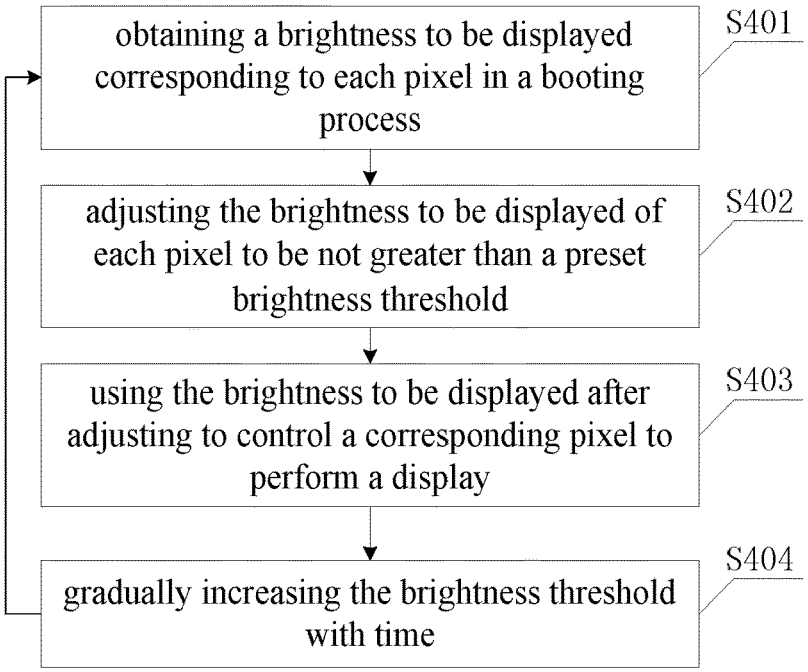
FIG. 4 is a flow chart of a brightness control method of an OLED panel in a booting process according to another embodiment of the present invention.

With reference to FIG. 4, and FIG. 4 is a flow chart of a brightness control method of an OLED panel in a booting process according to another embodiment of the present invention. In the present embodiment, the method includes following steps:

S401: obtaining a brightness to be displayed corresponding to each pixel in a booting process.

As the description in the S101, no more repeating.

S402: adjusting the brightness to be displayed of each pixel to be not greater than a preset brightness threshold.

Specifically, comparing the brightness to be displayed of each pixel with a preset brightness threshold. If a brightness to be displayed is greater than the brightness threshold, adjusting the brightness to be displayed to be less than or equal to the brightness threshold; if a brightness to be displayed is less than or equal to the brightness threshold, directly using the brightness to be displayed to control a corresponding pixel to perform a display.

S403: using the brightness to be displayed after adjusting to control a corresponding pixel to perform a display.

S404: gradually increasing the brightness threshold with time.

Wherein, after the step of gradually increasing the brightness threshold with time, the system will return to the step S401.

Wherein, after the booting period, the brightness to be displayed will gradually increase with the increasing of the brightness threshold. Specifically, according to brightness thresholds which are preset and corresponding to different moments to calculate a brightness threshold of a present moment through an interpolation method. Furthermore, after a preset moment, setting the brightness threshold to be greater than or equal to an allowable maximum brightness of the OLED panel.

Figure 5:
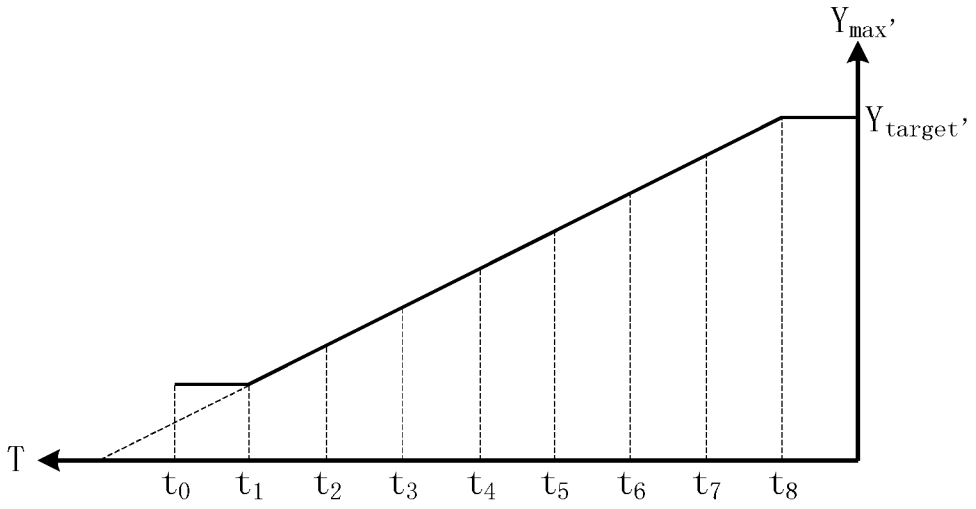
FIG. 5 is a schematic adjustment diagram of brightness in the booting process of the OLED panel.
Figure 6:
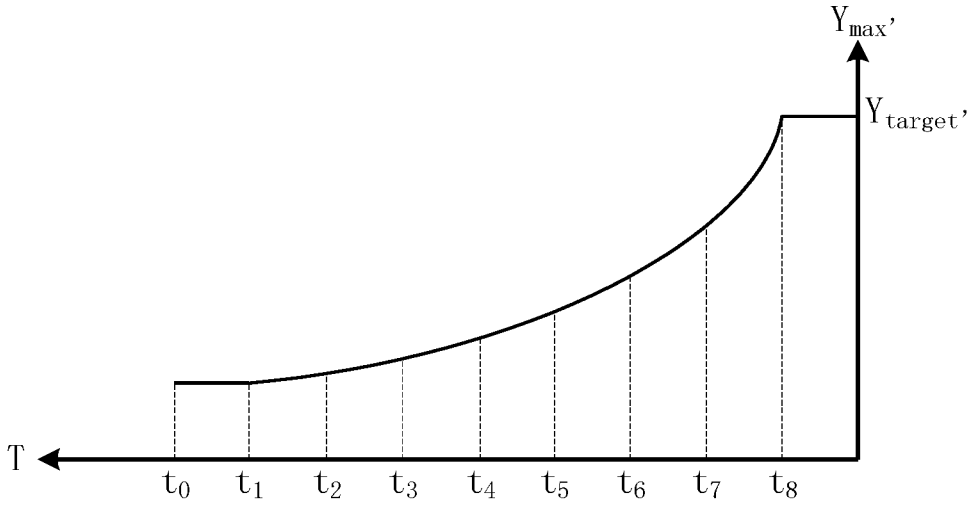
FIG. 6 is another schematic adjustment diagram of brightness in the booting process of the OLED panel.

In two application field, as shown in FIG. 5 and FIG. 6, FIG. 5 and FIG. 6 are two schematic adjustment diagrams of brightness in the booting process of the OLED panel. Wherein, FIG. 5 is a linear adjustment, and FIG. 6 is a non-linear adjustment. In each of FIG. 5 and FIG. 6, a time period from moment $t_0$ to moment $t_1$ is the above booting period. From moment $t_1$ to moment $t_8$, which is process that gradually increases the brightness threshold in order to increase the brightness to be displayed of the pixel.

In the present embodiment, obtaining a brightness to be displayed corresponding to each pixel in a booting process first. Then, comparing the brightness to be displayed of each pixel with a preset brightness threshold. If a brightness to be displayed is greater than the brightness threshold, adjusting the brightness to be displayed to be less than or equal to the brightness threshold. Then, using the brightness to be displayed after adjusting to control a corresponding pixel to perform a display. Accordingly, the brightness of the picture is decreased in the booting process in order to reduce the probability of the image sticking of the panel caused by too large voltage offset when booting, decreasing too fast ageing of the panel device because of too large local current.

Figure 7:
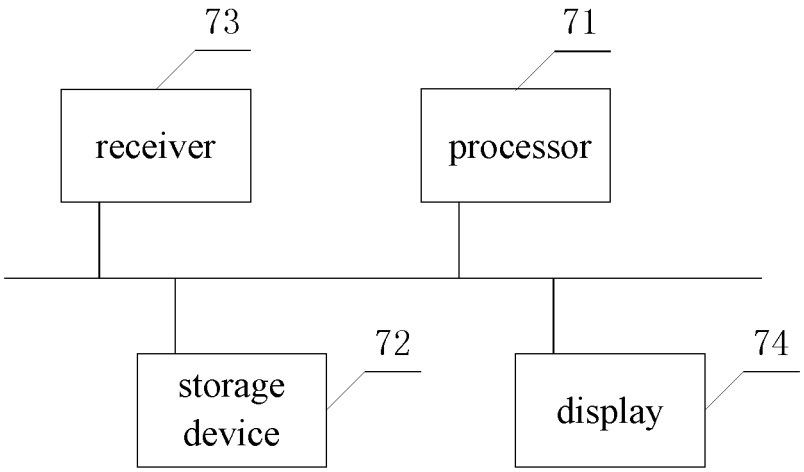
FIG. 7 is a schematic structure diagram of OLED panel according to an embodiment of the present invention.

With reference to FIG. 7, and FIG. 7 is a schematic structure diagram of OLED panel according to an embodiment of the present invention. The organic light-emitting panel can execute the steps executed by the OLED panel in the above methods. The related content can refer to the above illustration in the above methods, no more repeating here.

In the present embodiment, the processing device includes: a processor 71, a storage device 72 coupled with the processor 71, a receiver 73 and a display device 74.

The storage device 72 is used for storing an operation system, instructions for the processor 71, and received news.

The receiver 73 is used for obtaining a brightness to be displayed corresponding to each pixel in a booting process.

The display 74 is used for using the brightness to be displayed after adjusting to control a corresponding pixel to perform a display.

The processor 71 is used for comparing the brightness to be displayed of each pixel with a preset brightness threshold; if a brightness to be displayed is greater than the brightness threshold, adjusting the brightness to be displayed to be less than or equal to the brightness threshold.

The processor 71 is also used for obtaining a grayscale value to be displayed corresponding to each pixel; calculating the brightness to be displayed corresponding to each pixel according to the grayscale value to be displayed.

Wherein, the processor 71 is also used for obtaining a greatest grayscale value to be displayed in grayscale values to be displayed of different base colors corresponding to the multiple pixels; performing a gamma correction for the greatest grayscale value to be displayed; and using the greatest grayscale value to be displayed after the gamma correction as the brightness to be displayed corresponding to the pixel.

Specifically, the processor 71 is also used for through a following formula to perform the gamma correction for the greatest grayscale value to be displayed:

$$Y'=(Y/N)^{GMA}\times N;$$

wherein, Y is the greatest grayscale value to be displayed before the gamma correction, Y' is the greatest grayscale value to be displayed after the gamma correction, GMA is a gamma coefficient of the OLED panel, N is a greatest allowable grayscale value of the OLED panel.

Specifically, the processor 71 is also used for through a following formula to adjust a brightness to be displayed:

$$Y'_{out}=Y'\times K;$$

wherein, $K=Y_{th}/Y'_{max}$, Y' is a brightness to be displayed before adjustment, $Y'_{out}$ is a brightness to be displayed after adjustment, $Y_{th}$ is the brightness threshold, $Y'_{max}$ is a greatest brightness of the brightness to be displayed of the multiple pixels.

Specifically, the processor 71 is also using the brightness to be displayed after adjusting to adjust a grayscale value to be displayed of the pixel; using the grayscale value to be displayed to control a corresponding pixel to perform a display Wherein, the processor 71 is used for gradually increasing the brightness threshold with time.

Specifically, the processor 71 is used for according to brightness thresholds which are preset and corresponding to different moments to calculate a brightness threshold of a present moment through an interpolation method.

Specifically, the processor 71 is used for after a preset moment, setting the brightness threshold to be greater than or equal to an allowable maximum brightness of the organic light-emitting diode panel.

In the present embodiment, obtaining a brightness to be displayed corresponding to each pixel in a booting process first. Then, comparing the brightness to be displayed of each pixel with a preset brightness threshold. If a brightness to be displayed is greater than the brightness threshold, adjusting the brightness to be displayed to be less than or equal to the brightness threshold. Then, using the brightness to be displayed after adjusting to control a corresponding pixel to perform a display. Accordingly, the brightness of the picture is decreased in the booting process in order to reduce the probability of the image sticking of the panel caused by too large voltage offset when booting, decreasing too fast ageing of the panel device because of too large local current.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A method for controlling brightness of an organic light-emitting diode panel when booting, the organic light-emitting diode panel includes multiple pixels, and the method comprises step of:

obtaining a brightness to be displayed corresponding to each pixel in a booting process;

comparing the brightness to be displayed of each pixel with a preset brightness threshold;

if the brightness to be displayed is greater than the brightness threshold, adjusting the brightness to be displayed to be less than or equal to the brightness threshold;

using the brightness to be displayed after adjusting to adjust a grayscale value to be displayed of the pixel;

using the grayscale value to be displayed to control a corresponding pixel to perform a display; and gradually increasing the brightness threshold with time, and returning to the step of obtaining a brightness to be displayed corresponding to each pixel in a booting process.

2. The method according to claim 1, wherein, the method further comprises a step of: if the brightness to be displayed is less than or equal to the brightness threshold, directly using the brightness to be displayed to control the corresponding pixel to perform a display.

3. The method according to claim 1, wherein, the step of obtaining a brightness to be displayed corresponding to each pixel in a booting process comprises:

obtaining a grayscale value to be displayed corresponding to each pixel; and calculating the brightness to be displayed corresponding to each pixel according to the grayscale value to be displayed.

4. The method according to claim 3, wherein, the step of calculating the brightness to be displayed corresponding to each pixel according to the grayscale value to be displayed comprises:

obtaining a greatest grayscale value to be displayed in grayscale values to be displayed of different base colors corresponding to the multiple pixels;

performing a gamma correction for the greatest grayscale value to be displayed; and using the greatest grayscale value to be displayed after the gamma correction as the brightness to be displayed corresponding to the pixel.

5. The method according to claim 1, wherein, the step of performing a gamma correction for the greatest grayscale value to be displayed comprises a step of:

through a following formula to perform the gamma correction for the greatest grayscale value to be displayed:

$$Y'=(Y/N)^{GMA}\times N;$$

wherein, Y is the greatest grayscale value to be displayed before the gamma correction, Y' is the greatest grayscale value to be displayed after the gamma correction, GMA is a gamma coefficient of the OLED panel, N is a greatest allowable grayscale value of the OLED panel.

6. The method according to claim 1, wherein, the step of adjusting the brightness to be displayed to be less than or equal to the brightness threshold comprises a step of:

through a following formula to adjust a brightness to be displayed:

$$Y'\text{out}=Y'\times K;$$

wherein, K=Yth/Y'max, Y' is a brightness to be displayed before adjustment, Y'out is a brightness to be displayed after adjustment, Yth is the brightness threshold, Y'max is a greatest brightness of the brightness to be displayed of the multiple pixels.

7. The method according to claim 1, wherein, the step of gradually increasing the brightness threshold with time comprises:

according to brightness thresholds which are preset and corresponding to different moments to calculate a brightness threshold of a present moment through an interpolation method.

8. The method according to claim 1, wherein, the step of gradually increasing the brightness threshold with time comprises:

after a preset moment, setting the brightness threshold to be greater than or equal to an allowable maximum brightness of the organic light-emitting diode panel.

9. A method for controlling brightness of an organic light-emitting diode panel when booting, the organic light-emitting diode panel includes multiple pixels, and the method comprises step of:

obtaining a brightness to be displayed corresponding to each pixel in a booting process;

comparing the brightness to be displayed of each pixel with a preset brightness threshold;

if the brightness to be displayed is greater than the brightness threshold, adjusting the brightness to be displayed to be less than or equal to the brightness threshold; and using the brightness to be displayed after adjusting to control a corresponding pixel to perform a display.

10. The method according to claim 9, wherein, the method further comprises a step of: if the brightness to be displayed is less than or equal to the brightness threshold, directly using the brightness to be displayed to control the corresponding pixel to perform a display.

11. The method according to claim 9, wherein, the step of obtaining a brightness to be displayed corresponding to each pixel in a booting process comprises:

obtaining a grayscale value to be displayed corresponding to each pixel; and calculating the brightness to be displayed corresponding to each pixel according to the grayscale value to be displayed.

12. The method according to claim 11, wherein, the step of calculating the brightness to be displayed corresponding to each pixel according to the grayscale value to be displayed comprises:

obtaining a greatest grayscale value to be displayed in grayscale values to be displayed of different base colors corresponding to the multiple pixels;

performing a gamma correction for the greatest grayscale value to be displayed; and using the greatest grayscale value to be displayed after the gamma correction as the brightness to be displayed corresponding to the pixel.

13. The method according to claim 12, wherein, the step of performing a gamma correction for the greatest grayscale value to be displayed comprises a step of:

through a following formula to perform the gamma correction for the greatest grayscale value to be displayed:

$$Y'=(Y/N)^{GMA}\times N;$$

wherein, Y is the greatest grayscale value to be displayed before the gamma correction, Y' is the greatest grayscale value to be displayed after the gamma correction, GMA is a gamma coefficient of the OLED panel, N is a greatest allowable grayscale value of the OLED panel.

14. The method according to claim 9, wherein, the step of adjusting the brightness to be displayed to be less than or equal to the brightness threshold comprises a step of:

through a following formula to adjust a brightness to be displayed:

$$Y'\text{out}=Y'\times K;$$

wherein, K=Yth/Y'max, Y' is a brightness to be displayed before adjustment, Y'out is a brightness to be displayed after adjustment, Yth is the brightness threshold, Y'max is a greatest brightness of the brightness to be displayed of the multiple pixels.

15. The method according to claim 9, wherein, the step of using the brightness to be displayed after adjusting to control a corresponding pixel to perform a display comprises a step of:

using the brightness to be displayed after adjusting to adjust a grayscale value to be displayed of the pixel; and using the grayscale value to be displayed to control a corresponding pixel to perform a display.

16. The method according to claim 9, wherein, after the step of using the brightness to be displayed after adjusting to control a corresponding pixel to perform a display, the method comprises a step of:

gradually increasing the brightness threshold with time, and returning to the step of obtaining a brightness to be displayed corresponding to each pixel in a booting process.

17. The method according to claim 16, wherein, the step of gradually increasing the brightness threshold with time comprises:

according to brightness thresholds which are preset and corresponding to different moments to calculate a brightness threshold of a present moment through an interpolation method.

18. The method according to claim 16, wherein, the step of gradually increasing the brightness threshold with time comprises:

after a preset moment, setting the brightness threshold to be greater than or equal to an allowable maximum brightness of the organic light-emitting diode panel.

19. An organic light-emitting diode panel, and the panel comprises:

a processor, a storage device, a receiver and a display device, wherein, the processor is connected with the receiver and the display device;

the receiver is used for obtaining a brightness to be displayed corresponding to each pixel in a booting process;

the processor is used for comparing the brightness to be displayed of each pixel with a preset brightness threshold; if a brightness to be displayed is greater than the brightness threshold, adjusting the brightness to be displayed to be less than or equal to the brightness threshold; and the display is used for using the brightness to be displayed after adjusting to control a corresponding pixel to perform a display.

20. The organic light-emitting diode panel according to claim 19, wherein, if the brightness to be displayed is less than or equal to the brightness threshold, directly using the brightness to be displayed to control the corresponding pixel to perform a display.

* * * * *